US007805653B2

(12) United States Patent
Uchida et al.

(10) Patent No.: US 7,805,653 B2
(45) Date of Patent: Sep. 28, 2010

(54) LDPC-CODE GENERATING METHOD, COMMUNICATION APPARATUS, AND CODE-STRING GENERATING METHOD

(75) Inventors: Shigeru Uchida, Tokyo (JP); Akira Otsuka, Tokyo (JP); Wataru Matsumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 905 days.

(21) Appl. No.: 11/659,533

(22) PCT Filed: Jul. 13, 2005

(86) PCT No.: PCT/JP2005/012949

§ 371 (c)(1),
(2), (4) Date: Feb. 6, 2007

(87) PCT Pub. No.: WO2006/027897

PCT Pub. Date: Mar. 16, 2006

(65) Prior Publication Data

US 2007/0294607 A1 Dec. 20, 2007

(30) Foreign Application Priority Data

Sep. 3, 2004 (WO) ..... PCT/JP2004/012830

(51) Int. Cl.
*H03M 13/13* (2006.01)
*H03M 13/35* (2006.01)

(52) U.S. Cl. ..... 714/752; 714/778

(58) Field of Classification Search ..... 714/752, 714/778

See application file for complete search history.

(56) References Cited

U.S. PATENT DOCUMENTS

| | | | | |
|---|---|---|---|---|
| 6,715,121 | B1 | 3/2004 | Laurent | |
| 6,895,547 | B2 * | 5/2005 | Eleftheriou et al. | 714/801 |
| 6,985,536 | B2 * | 1/2006 | Oelcer et al. | 375/261 |
| 7,139,964 | B2 * | 11/2006 | Shen et al. | 714/758 |
| 2004/0005865 | A1 | 1/2004 | Eroz et al. | |
| 2004/0019845 | A1 | 1/2004 | Eroz et al. | |
| 2004/0028002 | A1 | 2/2004 | Eroz et al. | |
| 2004/0054960 | A1 | 3/2004 | Eroz et al. | |
| 2004/0086059 | A1 | 5/2004 | Eroz et al. | |
| 2004/0186992 | A1 | 9/2004 | Matsumoto | |

FOREIGN PATENT DOCUMENTS

| | | |
|---|---|---|
| JP | 2001-168733 A | 6/2001 |
| JP | 2003-198383 A | 7/2003 |

(Continued)

OTHER PUBLICATIONS

Sae-Young Chung et al., IEEE Transactions on Information Theory, vol. 47, No. 2, 2001, pp. 657-670.

(Continued)

*Primary Examiner*—Stephen M Baker
(74) *Attorney, Agent, or Firm*—Birch, Stewart, Kolasch & Birch LLP

(57) ABSTRACT

An order-ensemble searching unit classifies a distribution of reception signals at each bit position of a modulation symbol, and searches an order ensemble of a parity check matrix that minimizes an SNR threshold value. A code generating unit generates a parity check matrix and a generation matrix, based on the order ensemble obtained as a search result.

18 Claims, 18 Drawing Sheets

FOREIGN PATENT DOCUMENTS

| | | | |
|---|---|---|---|
| JP | 2004-80753 | A | 3/2004 |
| JP | 2004-88470 | A | 3/2004 |

OTHER PUBLICATIONS

Tom Richardson, Multi-edge type LDPC codes, On the occasion of Bob McEliece's 60th bithday celebration, Feb. 3, 2003.

Tom Richardson et al., Multi-Edge Type LDPC codes, Apr. 20, 2004, pp. 1-36.

Tadashi Wadayama, A Coded Modulation Scheme Based on Low Density Parity Check Codes, IEICE Transactions on Fundamentals, vol. E84-A, 2001, 10, pp. 2523-2527.

J. Hou et al., "Multilevel Coding with Low-Density Parity-Check Component Codes".

Pishro-Nik et al., Results on Non-uniform Error Correction Using Low-Density Parity-Check Codes, GLOBECOM 2003, pp. 2041-2045.

Hou et al., IEEE Transcations on Information Theory, vol. 49, No. 9, Sep. 2003, pp. 2141-2155.

Ravi Narayanaswami, Coded Modulation with Low Density Parity Check Codes, Jun. 2001, pp. 1-77. XP-002271230.

Sankar et al., Design of Low-density parity-check (LDPC) codes for high order constellations, IEEE Communications Society, Globecom 2004, pp. 3113-3117.

Shen et al., Low-Density Parity-Check Coded Modulation Using Multiple Signal Maps and Symbol Decoding, IEEE Communications Society, pp. 420-424.

Khandekar et al., Irregular repeat accumulate codes for non-binary modulation schemes, ISIT 2002, Jun. 30-Jul. 5, 2002, p. 171.

* cited by examiner

FIG.3

| VARIABLE | | | CONSTRAINT | |
|---|---|---|---|---|
| $V_{b,d}$ | b | d | $\mu_d$ | d |
| 0.5 | 0 1 | 2 0 0 0 | 0.4 | 4 1 0 0 |
| 0.3 | 0 1 | 3 0 0 0 | 0.1 | 3 2 0 0 |
| 0.2 | 1 0 | 0 3 3 0 | 0.2 | 0 0 3 1 |
| 0.2 | 0 1 | 0 0 0 1 | | |

| VARIABLE | | | CONSTRAINT | |
|---|---|---|---|---|
| $V_{b,d}$ | b | d | $\mu_d$ | d |
| 0.18 | 0 1 0 | 2 0 0 0 | 0.40 | 4 1 0 0 |
| 0.32 | 0 0 1 | 2 0 0 0 | 0.10 | 3 2 0 0 |
| 0.20 | 0 1 0 | 3 0 0 0 | 0.20 | 0 0 3 1 |
| 0.10 | 0 0 1 | 3 0 0 0 | | |
| 0.20 | 1 0 0 | 0 3 3 0 | | |
| 0.12 | 0 1 0 | 0 0 0 1 | | |
| 0.08 | 0 0 1 | 0 0 0 1 | | |

16 QAM GRAY MAPPING, AWGN OF SECOND AND FOURTH BITS

16 QAM GRAY MAPPING, AWGN OF FIRST AND THIRD BITS

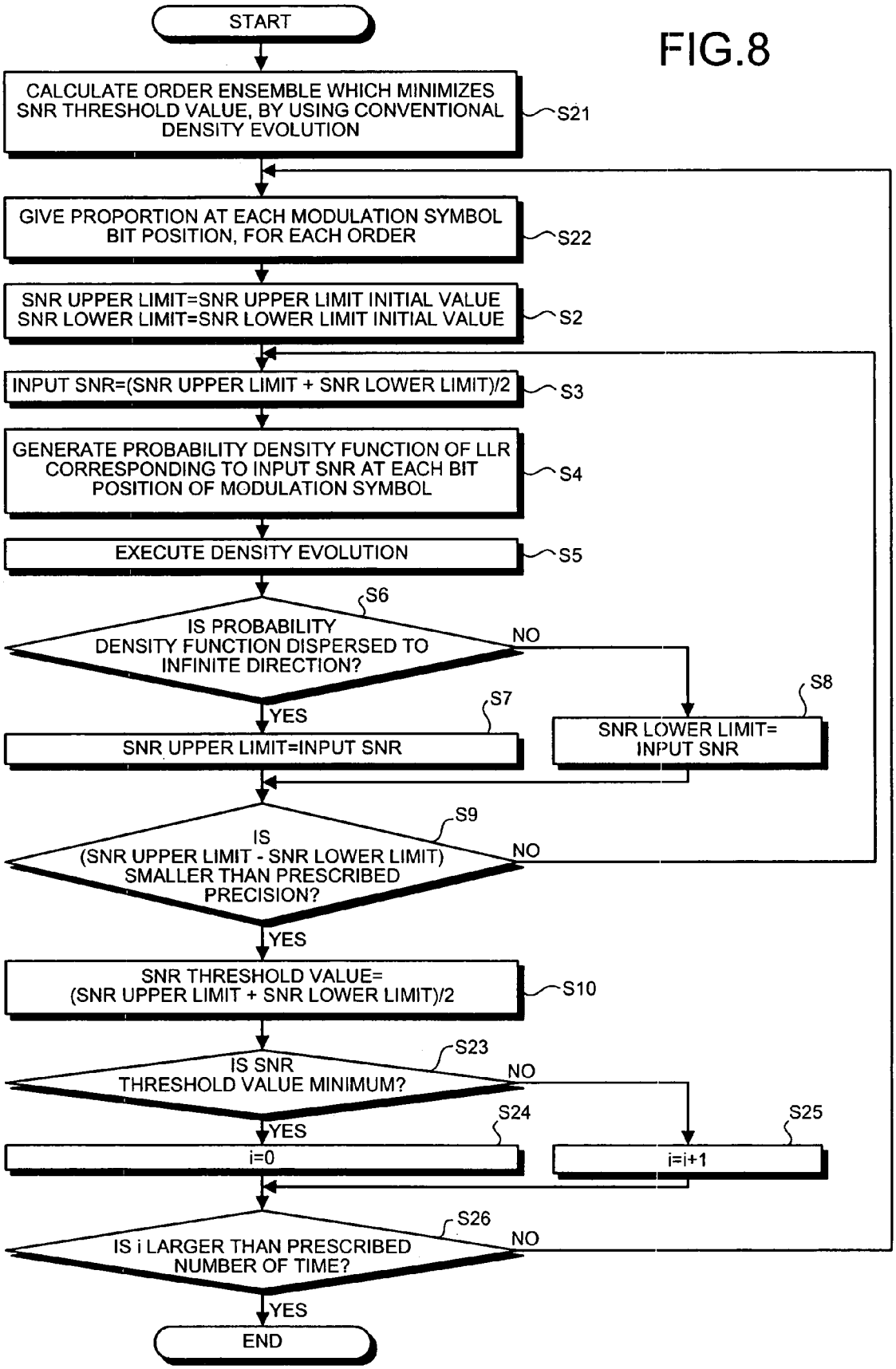
FIG.8
START
CALCULATE ORDER ENSEMBLE WHICH MINIMIZES SNR THRESHOLD VALUE, BY USING CONVENTIONAL DENSITY EVOLUTION
S21
GIVE PROPORTION AT EACH MODULATION SYMBOL BIT POSITION, FOR EACH ORDER
S22
SNR UPPER LIMIT=SNR UPPER LIMIT INITIAL VALUE
SNR LOWER LIMIT=SNR LOWER LIMIT INITIAL VALUE
S2
INPUT SNR=(SNR UPPER LIMIT + SNR LOWER LIMIT)/2
S3
GENERATE PROBABILITY DENSITY FUNCTION OF LLR CORRESPONDING TO INPUT SNR AT EACH BIT POSITION OF MODULATION SYMBOL
S4
EXECUTE DENSITY EVOLUTION
S5
S6
IS PROBABILITY DENSITY FUNCTION DISPERSED TO INFINITE DIRECTION?
NO
YES
S7
SNR UPPER LIMIT=INPUT SNR
S8
SNR LOWER LIMIT= INPUT SNR
S9
IS (SNR UPPER LIMIT - SNR LOWER LIMIT) SMALLER THAN PRESCRIBED PRECISION?
NO
YES
SNR THRESHOLD VALUE= (SNR UPPER LIMIT + SNR LOWER LIMIT)/2
S10
S23
IS SNR THRESHOLD VALUE MINIMUM?
NO
YES
S24
i=0
S25
i=i+1
S26
IS i LARGER THAN PRESCRIBED NUMBER OF TIME?
NO
YES
END

FIG.9

SNR THRESHOLD VALUE= 5.41 (dB)

| VARIABLE | | | CONSTRAINT | |
|---|---|---|---|---|
| $V_{b,d}$ | b | d | $\mu_d$ | d |
| 0.18375 | 0 1 0 | 2 0 0 0 | 0.40000 | 4 1 0 0 |
| 0.31625 | 0 0 1 | 2 0 0 0 | 0.10000 | 3 2 0 0 |
| 0.19725 | 0 1 0 | 3 0 0 0 | 0.20000 | 0 0 3 1 |
| 0.10275 | 0 0 1 | 3 0 0 0 | | |
| 0.20000 | 1 0 0 | 0 3 3 0 | | |
| 0.11900 | 0 1 0 | 0 0 0 1 | | |
| 0.81000 | 0 0 0 | 0 0 0 1 | | |

16 QAM GRAY MAPPING, AWGN OF SECOND AND FOURTH BITS

16 QAM GRAY MAPPING, AWGN OF FIRST AND THIRD BITS

FIG.10

SNR THRESHOLD VALUE= 9.59 (dB)

| VARIABLE | | | CONSTRAINT | |
|---|---|---|---|---|
| $V_{b,d}$ | b | d | $\mu_d$ | d |
| 0.11260 | 0 1 0 0 | 2 0 0 0 | 0.40000 | 4 1 0 0 |
| 0.15546 | 0 0 1 0 | 2 0 0 0 | 0.10000 | 3 2 0 0 |
| 0.23194 | 0 0 0 1 | 2 0 0 0 | 0.20000 | 0 0 3 1 |
| 0.16826 | 0 1 0 0 | 3 0 0 0 | | |
| 0.07227 | 0 0 1 0 | 3 0 0 0 | | |
| 0.05947 | 0 0 0 1 | 3 0 0 0 | | |
| 0.20000 | 1 0 0 0 | 0 3 3 0 | | |
| 0.05248 | 0 1 0 0 | 0 0 0 1 | | |
| 0.10560 | 0 0 1 0 | 0 0 0 1 | | |
| 0.04192 | 0 0 0 1 | 0 0 0 1 | | |

16 QAM GRAY MAPPING, AWGN OF THIRD AND SIXTH BITS

16 QAM GRAY MAPPING, AWGN OF SECOND AND FIFTH BITS

16 QAM GRAY MAPPING, AWGN OF FIRST AND FOURTH BITS

| MODULATION SYSTEM (GRAY MAPPING) | SNR THRESHOLD VALUE (dB) OF FIG. 3 | SNR THRESHOLD VALUE (dB) OF FIGS. 9 AND 10 | PERFORMANCE RATIO (dB) |
|---|---|---|---|
| 16 QAM | 5.49 | 5.41 | 0.08 |
| 64 QAM | 9.76 | 9.59 | 0.17 |

FIG.20

$$H = \begin{bmatrix} 0&1&0&0&1&1&0&1&0&0&1&1&0&0&0&1&0&1 \\ 1&0&1&0&0&0&0&1&1&0&1&0&0&1&1&0&1&0 \\ 0&1&1&0&0&0&1&0&1&1&0&1&0&0&0&0&1&1 \\ 0&0&1&1&0&0&0&1&0&0&0&1&0&1&0&0&0&1 \\ 0&0&0&1&0&1&0&0&1&0&0&1&1&0&0&0&1&0 \\ 0&0&1&0&1&0&0&0&1&0&0&0&1&0&1&0&0&1 \\ 1&0&0&0&1&0&0&0&0&0&1&0&0&0&1&0&0&0 \\ 0&1&0&0&0&1&0&0&0&0&0&0&0&0&1&1&0&0 \\ 0&0&0&0&0&1&1&0&0&1&0&0&0&1&0&0&0&0 \end{bmatrix}$$

64 QAM 1 2 3 4 5 6 1 2 3 4 5 6 1 2 3 4 5 6

16 QAM 1 2 3 4 1 2 3 4 1 2 3 4 1 2 3 4 1 2

GENERATE PARITY CHECK MATRIX FOR 64 QAM GRAY MAPPING

BIT POSITION OF 64 QAM GRAY MAPPING

POSITION AT WHICH ERROR PROBABILITY BECOMES LARGE

BIT POSITION OF 16 QAM GRAY MAPPING

REPLACEMENT OF COLUMNS $$H = \begin{bmatrix} 0&1&0&0&1&1&0&1&0&0&1&1&0&0&0&1&0&1 \\ 1&0&1&0&0&0&0&1&1&0&1&0&0&1&1&0&1&0 \\ 0&1&1&0&0&0&1&0&1&1&0&1&0&0&0&0&1&1 \\ 0&0&1&1&0&0&0&1&0&0&0&1&0&1&0&0&0&1 \\ 0&0&0&1&0&1&0&0&1&0&0&1&1&0&0&0&1&0 \\ 0&0&1&0&1&0&0&0&1&0&0&0&1&0&1&0&0&1 \\ 1&0&0&0&1&0&0&0&0&0&1&0&0&0&1&0&0&0 \\ 0&1&0&0&0&1&0&0&0&0&0&0&0&0&1&1&0&0 \\ 0&0&0&0&0&1&1&0&0&1&0&0&0&1&0&0&0&0 \end{bmatrix}$$

FIG.21

| VARIABLE | | | | | | | | CONSTRAINT | | | | |
|---|---|---|---|---|---|---|---|---|---|---|---|---|
| $v_{b,d}$ | b | | d | | | | | $u_d$ | d | | | |
| 0.25 | 0 | 1 | 3 | 3 | 0 | 0 | | 0.5 | 0 | 3 | 2 | 0 |
| 0.25 | 0 | 1 | 0 | 3 | 0 | 0 | | 0.25 | 2 | 0 | 0 | 2 |
| 0.5 | 1 | 0 | 0 | 0 | 2 | 1 | | 0.25 | 1 | 0 | 0 | 2 |
| 0.5 | 0 | 1 | 1 | 0 | 0 | 2 | | | | | | |

DISAPPEARANCE PROBABILITY 100% BEC

AWGN

| VARIABLE | | | | | | | | | CONSTRAINT | | | | |
|---|---|---|---|---|---|---|---|---|---|---|---|---|---|
| $v_{b,d}$ | b | | | d | | | | | $u_d$ | d | | | |
| 0.25×0.25 | 0 | 1 | 0 | 3 | 3 | 0 | 0 | | 0.5 | 0 | 3 | 2 | 0 |
| 0.25×0.75 | 0 | 0 | 1 | 3 | 3 | 0 | 0 | | 0.25 | 2 | 0 | 0 | 2 |
| 0.25×0.75 | 0 | 1 | 0 | 0 | 3 | 0 | 0 | | 0.25 | 1 | 0 | 0 | 2 |
| 0.25×0.25 | 0 | 0 | 1 | 0 | 3 | 0 | 0 | | | | | | |
| 0.5 | 1 | 0 | 0 | 0 | 0 | 2 | 1 | | | | | | |
| 0.50×0.50 | 0 | 1 | 0 | 0 | 0 | 0 | 1 | | | | | | |
| 0.50×0.50 | 0 | 0 | 1 | 0 | 0 | 0 | 1 | | | | | | |

ORDER CORRESPONDING PARITY BIT HAS EQUALLY PROBABILITY

DISAPPEARANCE PROBABILITY 100% BEC

16 QAM GRAY MAPPING, AWGN OF FIRST AND THIRD BITS

16 QAM GRAY MAPPING, AWGN OF SECOND AND FOURTH BITS

LDPC-CODE GENERATING METHOD, COMMUNICATION APPARATUS, AND CODE-STRING GENERATING METHOD

TECHNICAL FIELD

The present invention relates to a communication apparatus that employs an LDPC (Low-Density-Parity-Check) code as an error correction system, and, more particularly to a method of generating an LDPC code and a communication apparatus that search an optimum order ensemble of a parity check matrix in an LDPC code.

BACKGROUND ART

The following Nonpatent Literature 1 proposes a system that employs an LDPC code for each level of multilevel coding, as an encoding system in a multi-value modulation system. In this case, as a method of optimizing an LDPC code for each level, a probability density function that becomes an initial value at each position of a bit mapped in a modulation symbol. By using this probability density function, an optimum order ensemble (that shows a structure of a parity check matrix, and a numeral of "1" in a row or a column of the parity check matrix is expressed as an order (weight)) of the LDPC code at each bit position is obtained based on "Density Evolution".

Nonpatent Literature 1: J. Hou, Paul H. Siegel, Laurence B. Milstein, and Henry D. Pfister, "Multilevel Coding with Low-Density Parity-Check Component Codes, 2" Proceedings of IEEE Global Telecommunications Conference, San Antonio, Tex., USA, Nov. 25-29, 2001

DISCLOSURE OF INVENTION

Problem to be Solved by the Invention

However, the system according to the multilevel coding proposed in the Nonpatent Literature 1 has a problem that an encoder and a decoder need to be prepared at each bit position mapped in the modulation symbol, which results in the increase in a circuit scale.

Further, according to the system based on the multilevel coding, an information length needs to be divided for each number of bits mapped to the modulation symbol, thereby executing encoding. However, it is generally known that characteristics of an LDPC code tend to be degraded when a code length becomes short.

The present invention has been achieved in view of the above problems. It is an object of the present invention to obtain a method of generating an LDPC code capable of generating a code suitable for a multi-value modulation system using one LDPC code, while avoiding the increase in the circuit scale.

Means for Solving Problem

To solve the above problem, and to achieve the object, a method of generating an LDPC (Low-Density-Parity-Check) code according to one aspect of the present invention is applicable to a multi-value modulation system. The method includes ensemble searching including classifying a distribution of reception signals at each bit position of a modulation symbol, and searching an order ensemble (an ensemble of weight of a row and weight of a column) of a parity check matrix that minimizes an SNR (Signal to Noise Ratio) threshold value (a value of the SNR at which the bit error rate drops sharply when a code length is sufficiently large); and generating a parity check matrix and a generation matrix, based on the order ensemble obtained as a search result.

EFFECT OF THE INVENTION

In the method of generating the LDPC code according to the present invention, an order ensemble of a parity check matrix that minimizes an SNR threshold value is searched, after classifying a distribution of reception signals at each bit position of a modulation symbol. Further, a parity check matrix and a generation matrix are generated, following the order ensemble. Therefore, there is an effect that a communication system that can achieve encoding suitable for a multi-value modulation system can be built using one LDPC code.

BRIEF DESCRIPTION OF DRAWINGS

FIG. 3 is one example of an order ensemble of a multi-edge-type LDPC code;

FIG. 8 is a flowchart of a method of searching an order ensemble according to a second embodiment;

FIG. 9 is one example of a result of searching the order ensemble following a procedure shown in FIG. 8;

FIG. 10 is one example of the result of searching the order ensemble following the procedure shown in FIG. 8;

FIG. 20 is a specific example of a method of generating an LDPC code according to the fourth embodiment;

FIG. 21 depicts a method of searching an order ensemble according to a fifth embodiment;

EXPLANATIONS OF LETTERS OR NUMERALS

Figure 1:
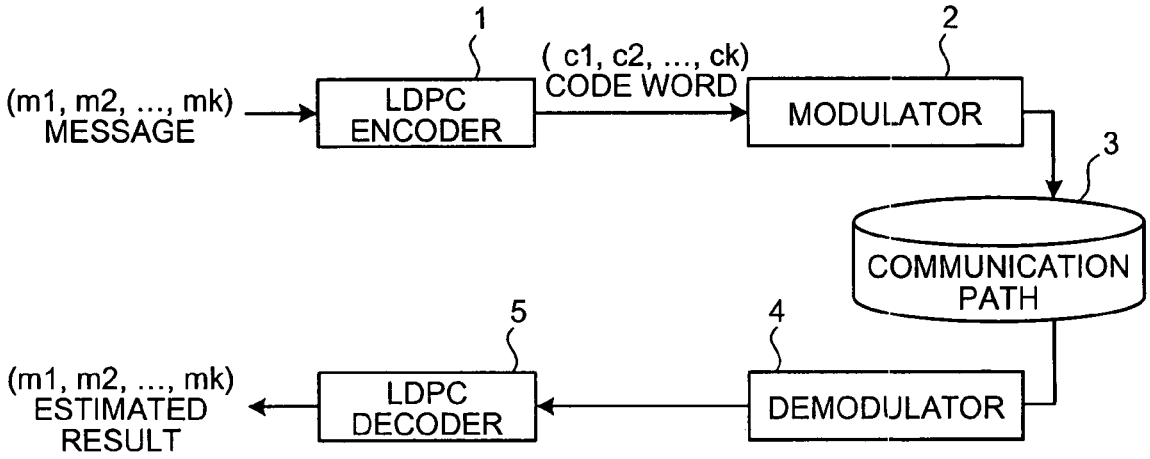
FIG. 1 depicts a configuration of a communication system including an LDPC encoder/decoder.

1 LDPC encoder
2 Modulator
3 Communication path
4 Demodulator
5 LDPC decoder
6 Communication-path quality estimator
11, 11*a* Encoder
12 Communication-path type estimator
13 Order ensemble calculator
14, 14*a* LDPC code generator

BEST MODE(S) FOR CARRYING OUT THE INVENTION

Exemplary embodiments of a method of generating an LDPC code according to the present invention will be explained below in detail with reference to the accompanying drawings. Note that the invention is not limited to the embodiments.

First Embodiment

First, positioning of an encoder that can achieve a method of generating an LDPC code according to the present embodiment, within a communication system, is explained. FIG. 1 depicts a configuration of a communication system including an LDPC encoder/decoder. In FIG. 1, a communication apparatus at a transmission side has a configuration including an LDPC encoder 1 and a modulator 2, and a communication apparatus at a reception side has a configuration including a demodulator 4 and an LDPC decoder 5.

Encoding and a flow of a code when an LDPC code is employed are briefly explained below. The LDPC encoder 1 at the transmission side generates a generation matrix G of k×n (where k denotes a length of information, and n denotes a length of a code), by using the method of generating an LDPC code according to the present embodiment described later. The LDPC encoder 1 receives a message ($m_1$, $m_2$, . . . , $m_k$) of the information length k, and generates a code word C as shown in Equation (1), using this message and the generation matrix G. When a parity check matrix for the LDPC is H, the generation matrix G becomes a matrix that satisfies $GH^T=0$ (where T denotes a transposed matrix), and $H(c_1, c_2, \ldots, c_n)^T=0$.

$$C = (m1, m2, \ldots, mk)G \quad (1)$$
$$= (c1, c2, \ldots, c_n)$$

The modulator 2 digitally modulates the code word C generated by the LDPC encoder 1, using a modulation system having a multi-value number such as a multi-valued PSK, a multi-valued QAM, or the like. The modulator 2 transmits the modulation signal to the reception side via a communication path 3.

On the other hand, at the reception side, the demodulator 4 digitally demodulates the modulation signal received via the communication path 3, using the multi-valued PSK, the multi-value QAM, or the like. Further, the LDPC decoder 5 executes a repetition decoding according to "sum-product algorithm", to a log likelihood ratio (LLR) that becomes a result of the demodulation, and outputs a result of estimation (corresponding to the original $m_1$, $m_2$, . . . , $m_k$).

Next, an error characteristic of the demodulation result obtained from the modulation signal, in the multi-value modulation is explained. In the multi-value modulation, an error probability at each bit position is different, depending on a mapping method of "0" and "1" to a modulation point. This is explained using an example of "16 QAM Gray Mapping" shown in FIG. 2. A first bit is taken into consideration first, and when an I component is fixed, all values of a Q component become the same. Therefore, when an error probability is considered, only the I component is considered. When "0" is transmitted as a transmission signal, a probability that a reception signal is "0" (a probability of obtaining a correct signal) and a probability that a reception signal is "1" (a probability of obtaining a wrong signal) are obtained, as shown in following expressions (2) and (3), respectively.

$$p(y|x=-3)+p(y|x=-1) \quad (2)$$

$$p(y|x=+1)+p(y|x=+3) \quad (3)$$

In the above expressions, x denotes a transmission signal, y denotes a reception signal, and p(y|x|) denotes a probability that, when the transmission signal is x, the reception signal received through the communication path 3 is y.

Next, when a second bit is taken into consideration, an error probability when a transmission signal is "0" is different from an error probability when a transmission signal is "1". That is, when "0" is transmitted as a transmission signal, a probability that a reception signal is "0" (a probability of obtaining a correct signal) and a probability that a reception signal is "1" (a probability of obtaining a wrong signal) are obtained, as shown in following expressions (4) and (5), respectively. On the other hand, when "1" is transmitted as a transmission signal, a probability that a reception signal is "1" (a probability of obtaining a correct signal) and a probability that a reception signal is "0" (a probability of obtaining a wrong signal) are obtained, as shown in the expressions (4) and (5), respectively.

$$p(y|x=-3)+p(y|x=+3) \quad (4)$$

$$p(y|x=-1)+p(y|x=+1) \quad (5)$$

For a third bit and a fourth bit, when the Q component is fixed, all values of the I component are the same. Therefore, error probabilities can be considered in a similar manner to that of the first bit and the second bit.

As explained above, error probabilities are different at each bit position of a modulation symbol. Therefore, there is a possibility of being able to generate a code having higher performance, by considering the different error probabilities.

A multi-edge-type LDPC code-is explained next. The multi-edge-type LDPC code is an LDPC code proposed in a literature 'T. Richardson, and R. Urbanke, "Modern Coding Theory," available at http://lthcwww.epfl.ch/papers/ics.ps'. By classifying a distribution of a reception signal, this can be reflected in a code structure.

FIG. 3 is one example of an order ensemble of the multi-edge-type LDPC code in the above literature. In the column of b in FIG. 3, a first column represents a BEC (Binary Erasure Channel) of a disappearance probability, and a second column represents an order of an AWGN (Additive White Gaussian Noise) channel. The column of d represents an order of each edge type between a variable node and a check node. The column of $v_{b,d}$ represents a proportion of a variable node represented by b and d. The column of $u_d$ represents a proportion of a check node represented by d.

When the order ensemble shown in this example is analyzed by the "Density Evolurion" method described in the above literature, an SNR threshold value (an average value of an SNR at which a bit error rate drops sharply when the code length is sufficiently large) is obtained. An order ensemble that minimizes this SNR threshold value is searched, and a code is structured based on this order ensemble, thereby obtaining a high-performance code.

Figure 2:
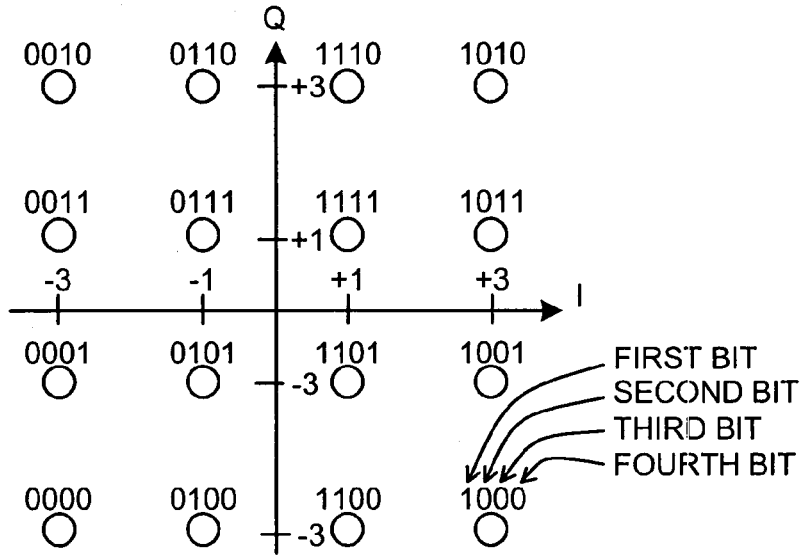
FIG. 2 is one example of "16 QAM Gray Mapping"
Figure 4:
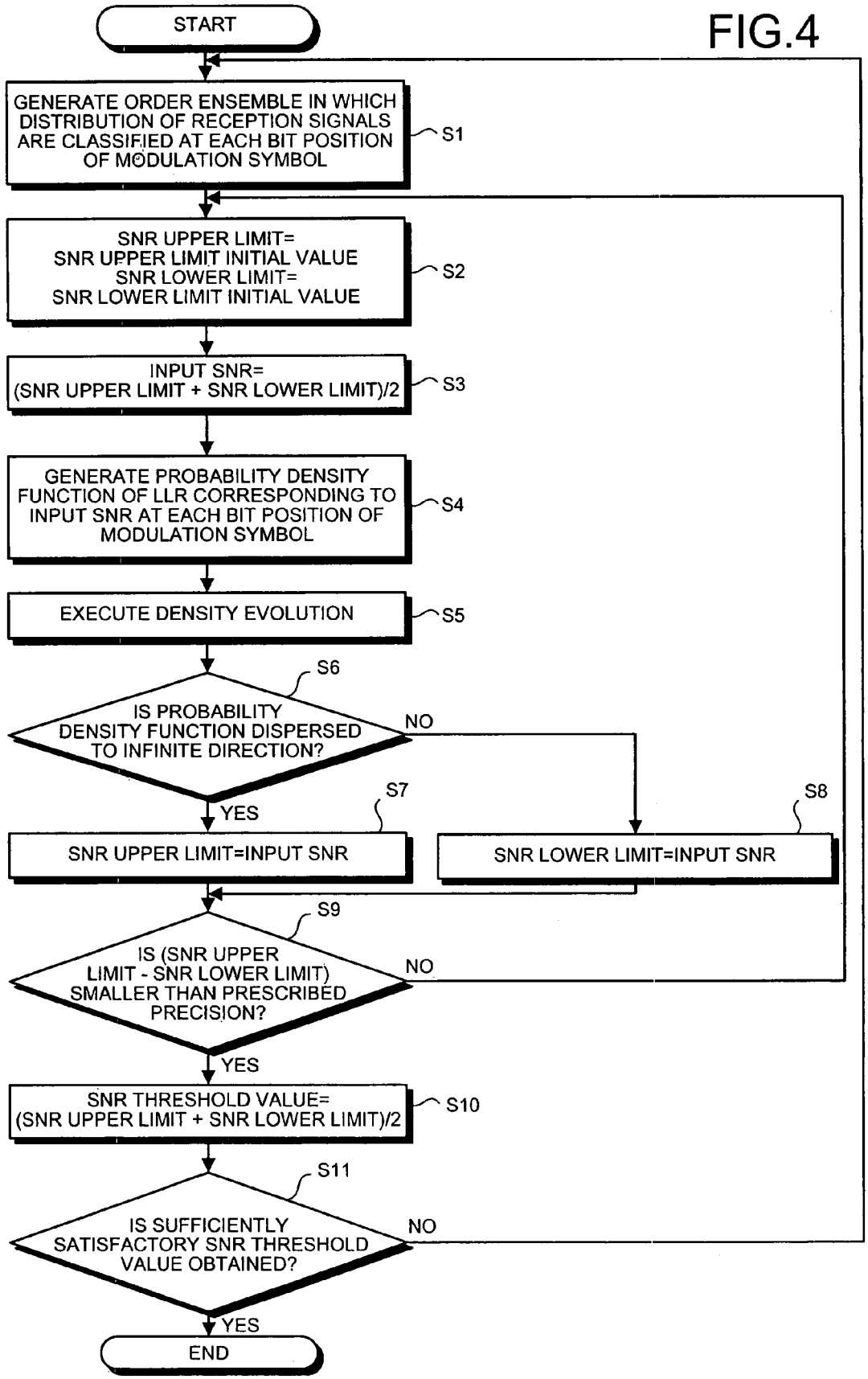
FIG. 4 is an explanatory diagram of a method of searching an order ensemble according to a first embodiment of the present invention.
Figures 5, 6:
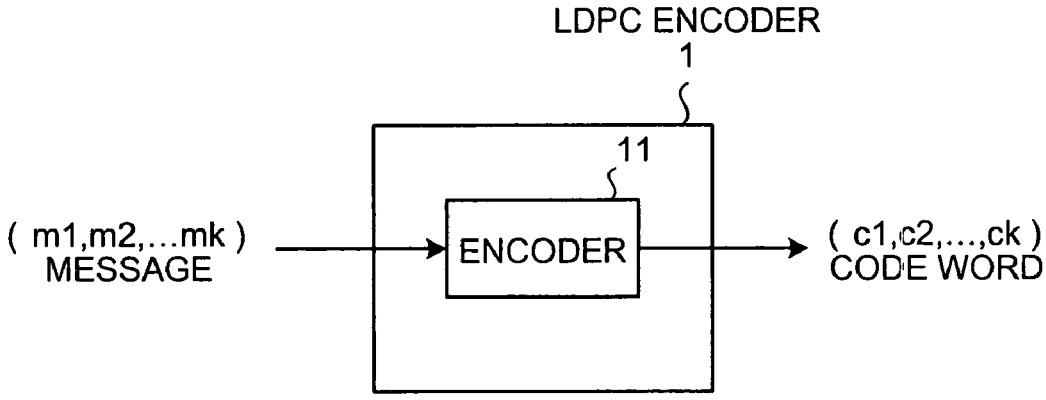
FIG. 5 is an explanatory diagram of the method of searching an order ensemble according to the first embodiment.
FIG. 6 is one example a configuration of an LDPC encoder.

The method of generating an LDPC code according to the present embodiment, specifically, a method of searching an order ensemble, is explained next, based on the above explanation. FIG. 4 and FIG. 5 are explanatory diagrams of the method of searching an order ensemble according to the present embodiment. While the example of the "16 QAM Gray Mapping" shown in FIG. 2 is used as a specific example in the present embodiment, a modulation and a mapping method are not limited to an M value QAM and the "Gray Mapping", and a multi-value modulation other than the M value QAM and a mapping method other than the "Gray Mapping" can be also applied in a similar manner. While a communication path is the AWGN channel in the present embodiment, the communication channel is not limited to this.

First, the LDPC encoder 1 searches an order ensemble of a parity check matrix, after classifying a distribution of a reception signal at each bit position of a modulation symbol (step S1 in FIG. 4). For example, as shown in FIG. 5, the AWGN of the column of b is divided at each bit position of a modulation symbol, in the order ensemble shown in FIG. 3. In this case, a proportion at each bit position is set equal, that is, a sum of $V_{b,d}$ in the distribution of the divided reception signals is set equal (a constraint). In addition to the above constraint, another constraint can be also added, such as a part of the proportion of the order is fixed to set a triangular area at the right upper side of the parity check matrix H to "0". The reason for arranging the first bit and the third bit, and the second bit and the fourth bit, respectively is described later.

The LDPC encoder 1 then substitutes a predetermined initial value (a value which is considered sufficient as a search range), in an upper limit and a lower limit of the search range (step S2). The LDPC encoder 1 calculates an average value of the SNR search upper limit and the SNR search lower limit (step S3).

Next, the LDPC encoder 1 generates a probability density function of the LLR at each bit position of a modulation symbol, using the above calculated average value (the input SNR) as an input (step S4). In the example of the "16 QAM Gray Mapping" shown in FIG. 2, the LLR of a first bit is obtained as Equation (6) from the above expressions (2) and (3). A probability density function of the LLR in Equation (6) is obtained, by considering the probability density function of the reception signal of the transmission signal "0".

[Numerical Expression 1]

$$LLR = \ln\frac{P(y \mid x=-3)+P(y \mid x=-1)}{P(y \mid x=+1)+P(y \mid x=+3)} \tag{6}$$

In the second bit, the error probability when the transmission signal "0" is different from the error probability when the transmission signal is "1", as described above. Therefore, when the transmission signal is "0", the probability density function of the LLR is obtained in a similar manner to that of the first bit. However, when the transmission signal is "1", the LLR is obtained by replacing "0" and "1" of the mapping in FIG. 2, thereby obtaining the probability density function of the LLR. The two probability density functions are averaged to obtain the probability density function of the LLR of the second bit.

For the third bit and the fourth bit, the probability density functions that are exactly the same as those of the first bit and the second bit are obtained, respectively. Therefore, the probability density functions of the LLR are classified into two of the first and the third bits, and the second and the fourth bits.

Next, the LDPC encoder 1 executes "Density Evolution", by using, as inputs, the order ensemble generated at step S1 and the probability density function of the LLR generated at step S4 (step S5).

Next, the LDPC encoder 1 determines whether the probability density function of the LLR updated by the repetition process is dispersed to an infinite direction, as a result of executing the "Density Evolution" (step S6). For example, when the probability density function is dispersed to an infinite direction (step S6, Yes), it can be determined that the SNR threshold value is present in a direction of much smaller than the input SNR (the average value). Therefore, the LDPC encoder 1 updates the search upper limit of the SNR to the input SNR (step S7). On the other hand, when the probability density function is not dispersed to an infinite direction (step S6, No), it can be determined that the SNR threshold value is present in a direction of larger than the input SNR. Therefore, the LDPC encoder 1 updates the search lower limit of the SNR to the input SNR (step S8).

Next, the LDPC encoder 1 subtracts the search lower limit of the SNR from the search upper limit of the SNR. When the precision becomes equal to or lower than that prescribed beforehand (when the precision reaches a predetermined level) (step S9, Yes), the LDPC encoder 1 leaves a search processing loop of the SNR threshold value (steps S3 to S9), and calculates an average of the search upper limit of the SNR and the search lower limit of the SNR, thereby obtaining an SNR threshold value (a limit value of the SNR) (step S10). On the other hand, when the precision does not reach the set level (step S9, No), the LDPC encoder 1 executes the search processing loop of the SNR threshold value again.

Next, the LDPC encoder 1 determines whether the SNR threshold value obtained above is a sufficiently satisfactory SNR threshold value (step S10: the LDPC encoder 1 determines whether the SNR threshold value is equal to or larger than a specific threshold value, or is the most satisfactory value for a specific number of times of searching). For example, when a sufficiently satisfactory SNR threshold value is obtained (step S10, Yes), the LDPC encoder 1 determines this value as an SNR threshold value (an average value of the SNR at which a bit error rate drops sharply when the code length is sufficiently large), and outputs an order ensemble that minimizes the SNR threshold value. On the other hand, when a sufficiently satisfactory SNR threshold value is not obtained (step S10, No), the LDPC encoder 1 determines whether to return to step S1 and execute the SNR threshold value search process of other order ensemble (steps S1 to S11) or end the process. When the LDPC encoder 1 returns to step S1 and executes the SNR threshold value search process of other order ensemble, the LDPC encoder 1 generates, in the above search process, a new order ensemble, by using an optimization method such as the "Differential Evolution (R. Storn, and K. Price, "Differential Evolution—A simple and efficient adaptive scheme for global optimization over continuous spaces", Technical Report TR-95-012, ICSI)" that is proposed by R. Storn, et al., to the order ensemble at this time.

Based on the order ensemble obtained as described above, the LDPC encoder 1 then generates the parity check matrix H, according to the method using a Euclid geometric code described in Japanese Patent Application Laid-open No. 2003-198383, for example, and generates the generation matrix G. In generating the LDPC code, the parity check matrix H can be generated according to the conventional method, based on the conventional order ensemble as shown in FIG. 3, for example, without classifying the distribution of reception signals at each bit position of a modulation symbol, and columns of the parity check matrix H can be rearranged, based on the order ensemble shown in FIG. 5.

As described above, in the present embodiment, the distribution of reception signals is classified at each bit position of a modulation symbol, and an order ensemble is searched that minimizes the SNR threshold value (an average value of the SNR at which the bit error rate drops sharply when the code length is sufficiently large). Further, a parity check matrix and a generation matrix are generated, following the order ensemble that minimizes the SNR threshold value. As a result, a communication system capable of achieving the encoding suitable for the multi-value modulation system using one LDPC code can be built up.

Figure 7:
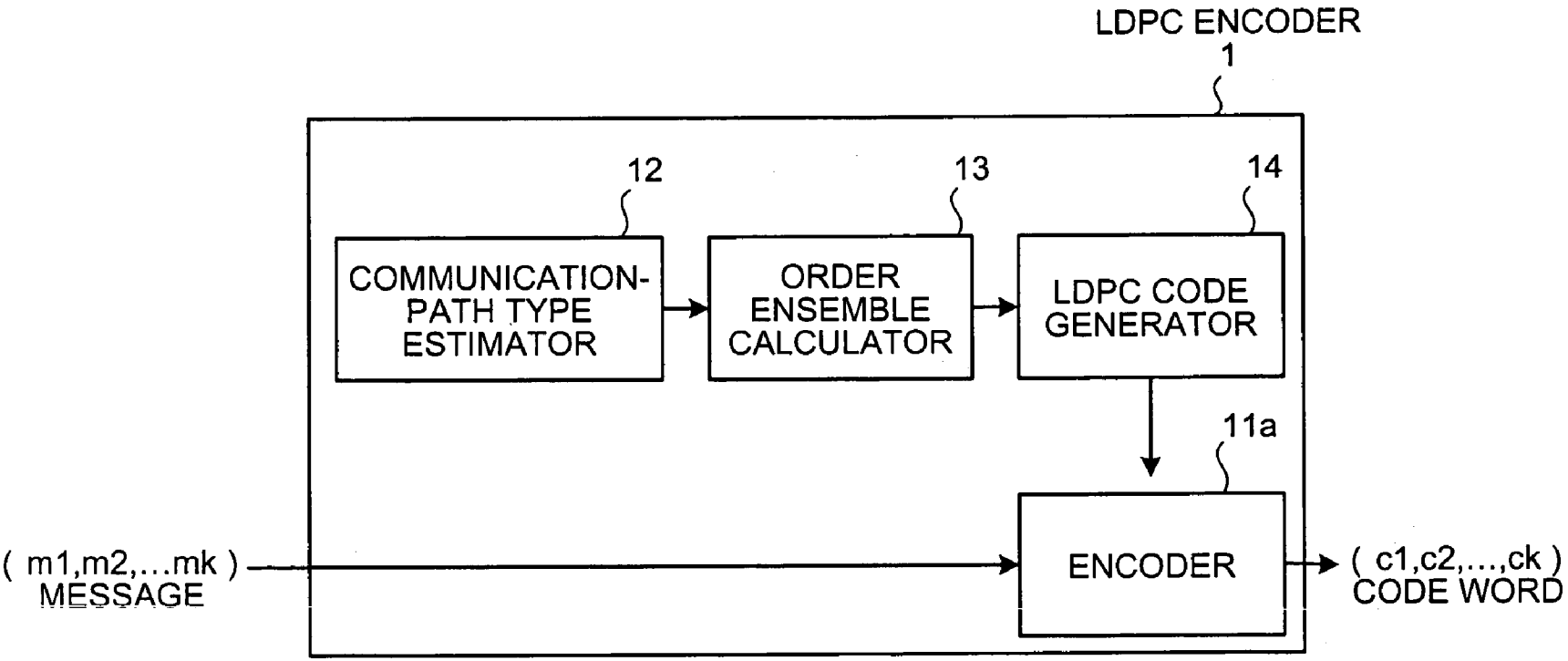
FIG. 7 is one example a configuration of the LDPC encoder.

In the present embodiment, the LDPC code generated in the above method can be directly held in an encoder 11 within the LDPC encoder 1, as shown in FIG. 6, for example. Alternatively, as shown in FIG. 7, a communication-path type estimator 12 within the LDPC encoder 1 can estimate a communication path type that becomes a model of the AWGN channel and a Rayleigh fading channel, and then an order ensemble calculator 13 and an LDPC code generator 14 can generate an LDPC code in real time, based on the method of generating an LDPC code according to the present embodiment. In this case, the generated parity check matrix H and the generation matrix G are input to an encoder 11*a*, and the parity check matrix H is transmitted to the reception side through the encoder 11*a*.

The method of generating an LDPC code according to the present embodiment can be also applied to an order ensemble of an irregular LDPC code, as well as a multi-edge-type LDPC code. Following Equations (7) and (8) represent generation functions of the order distribution of a variable node and a check node, respectively, where $\lambda_i$ and $\rho_i$ represent rates of edges ("1" of the parity check matrix H is expressed as an edge) that belong to the variable node and the check node of an order i, respectively, $d_l$ denotes a maximum order of the variable node, and $d_r$ denotes a maximum order of the check node.

[Numerical Expression 2]

$$\lambda(x) = \sum_{i=2}^{d_l} \lambda_i X^{i-1} \tag{7}$$

[Numerical Expression 3]

$$\rho(x) = \sum_{i=2}^{d_r} \rho_i X^{i-1} \tag{8}$$

Next, generation functions of the order distribution of the variable node and the check node are expressed as shown in Equations (9) and (10), based on $\lambda_i^k$ and $\rho_i^k$ that are classifications of $\lambda_i$ and $\rho_i$ at each bit position k of a modulation symbol, corresponding to Equations (7) and (8). Further, the probability density function of the LLR is classified for each bit position of a modulation symbol, and an order ensemble that minimizes the SNR is obtained by the method of generating an LDPC code according to the present embodiment, thereby generating the LDPC code.

[Numerical Expression 4]

$$\lambda(x) = \sum_{k=1}^{n} \sum_{i=2}^{d_l} \lambda_i^k X^{i-1} \tag{9}$$

[Numerical Expression 5]

$$\rho(x) = \sum_{k=1}^{n} \sum_{i=2}^{d_r} \rho_i^k X^{i-1} \tag{10}$$

Second Embodiment

According to a second embodiment of the present invention, the process is divided into two stages, in searching an order ensemble in which the SNR threshold value is sufficiently small, in the method of generating an LDPC code according to the first embodiment. With this arrangement, a calculation time necessary for the searching is shortened. A configuration of the communication system according to the present embodiment is similar to that shown in FIG. 1 of the first embodiment.

FIG. 8 is a flowchart of a method of searching an order ensemble according to the second embodiment. In the present embodiment, only the process that is different from that of the first embodiment is explained.

According to the present embodiment the LDPC encoder 1 calculates an order ensemble (FIG. 8, step S21: for example, a conventional order ensemble as shown in FIG. 3 is obtained) that minimizes the SNR threshold value, without classifying a distribution of reception signals at each bit position of a modulation symbol. In this case, instead of executing the process at step S21, a known order ensemble can be fixedly used, without classifying the distribution of reception signals at each bit position of a symbol.

Next, the LDPC encoder 1 gives a proportion at each modulation symbol bit position, for each order, and generates an order ensemble of a parity check matrix, using an optimization method such as the "Differential Evolution", with the proportion used as a parameter (step S22). In this case, a sum of proportions for each order is prescribed to become 1, and a proportion at each bit position is determined to be equal, as constraints of the parameter. Constraints other than the above can be also added.

The process of step S22 is explained with reference to FIG. 3 and FIG. 5. The order of a first row of the variable node in FIG. 3 is taken into consideration. The proportion of "0.5" is divided into a proportion of "0.5×0.36" in the first row and a proportion of "0.5×0.64" in the second row, as shown in FIG. 5. A total of the proportions of the variable node of the AWGN of the first and the third bits and a total of proportions of the variable node of the AWGN of the second and the fourth bits are 0.5, respectively, and are equal.

The LDPC encoder 1 executes the process at steps S2 to S10 in a similar manner to that according to the first embodiment, and determines whether an order ensemble that minimizes the SNR threshold value is obtained (step S23). For example, when an order ensemble that minimizes the SNR threshold value is obtained (step S23, Yes), the variable i is initialized to 0 (step S24). When an order ensemble that minimizes the SNR threshold value is not obtained (step S23, No), the variable i is incremented (step S25). Based on this process, a number of times when the order ensemble that minimizes the SNR threshold value is compared with other order ensemble is counted.

Finally, when the variable i becomes larger than a set prescribed number of times (step S26, Yes), the LDPC encoder 1 outputs an order ensemble that minimizes the SNR threshold value. When the variable i becomes smaller than a set prescribed number of times (step S26, No), the process returns to step S22, and the LDPC encoder 1 generates a new order ensemble by the optimization method such as the "Differential Evolution" by changing the proportion at each bit position of the modulation symbol.

Figures 11, 12:
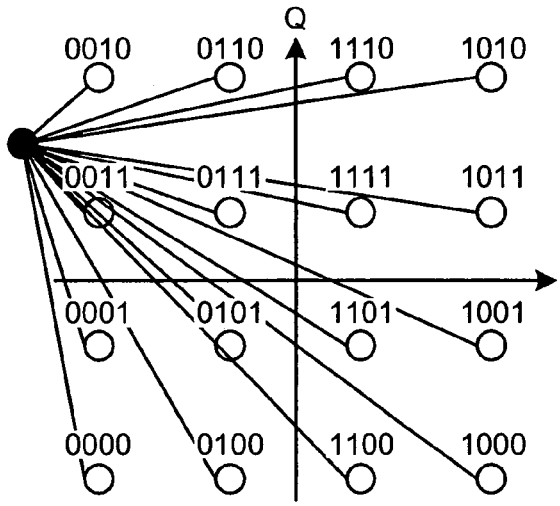
FIG. 11 is a table of a result of comparing an SNR threshold value obtained from the order ensemble shown in FIG. 3 and an SNR threshold value obtained based on the procedure shown in FIG. 8.
FIG. 12 is an explanatory diagram of a calculation process of a probability density function of an LLR according to a third embodiment.

FIG. 9 and FIG. 10 depict a result of obtaining an order ensemble of the "16 QAM Gray Mapping" or the "64 QAM Gray Mapping" by the process of FIG. 8 in the present embodiment, by fixedly using the order ensemble shown in FIG. 3, as an example of a numerical analysis of the present embodiment. FIG. 11 depicts a result of comparison between the SNR threshold value obtained from the order ensemble shown in FIG. 3 without using the process shown in FIG. 8 according to the present embodiment, and the SNR threshold value obtained in the process shown in FIG. 8 according to the present embodiment. As shown in FIG. 11, in both modulation systems, it is clear that the process shown in FIG. 8 according to the present embodiment makes it possible to generate an order ensemble that minimizes the SNR threshold value, as compared with the order ensemble shown in FIG. 3. In the modulation system having a large multi-value number, the distribution of reception signals can be classified into details. Therefore, the effect of execution of the process shown in FIG. 8 according to the present embodiment is large.

As described above, according to the present embodiment, a substantial increase in the calculation amount due to the increase in parameters in the order ensemble search process can be avoided, as compared with the increase in the first embodiment. Further, an order ensemble that minimizes the SNR threshold value can be searched by analysis in a short time.

Third Embodiment

In a third embodiment, the LDPC decoder 5 calculates a probability density function of the LLR, in addition to the LLR calculation process, in the method of generating an LDPC code according to the first and the second embodiments. A configuration of a communication system according to the present embodiment is similar to that shown in FIG. 1 of the first embodiment.

Figure 13:
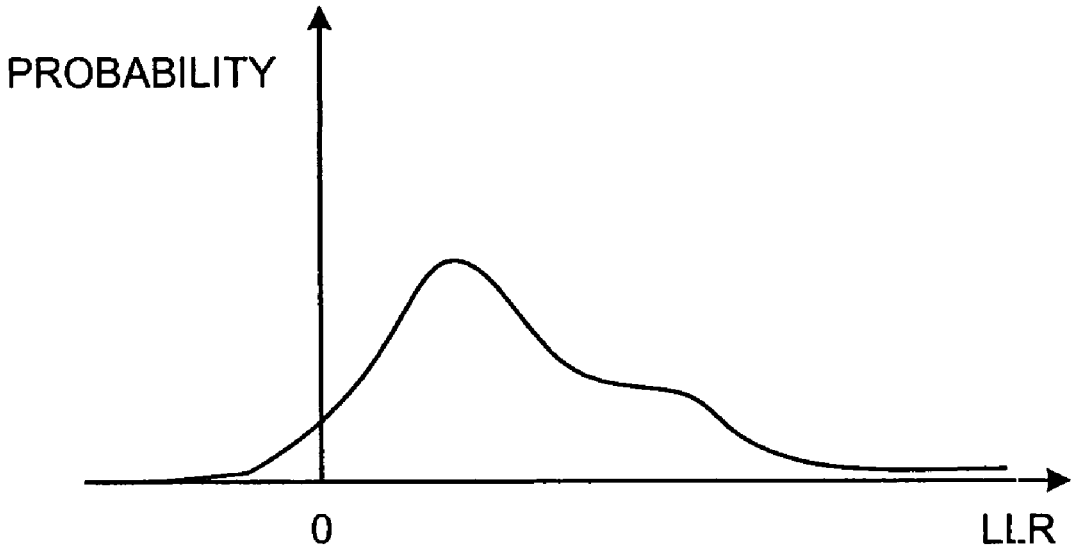
FIG. 13 is an explanatory diagram of a calculation process of a probability density function of an LLR according to a third embodiment.
Figure 14:
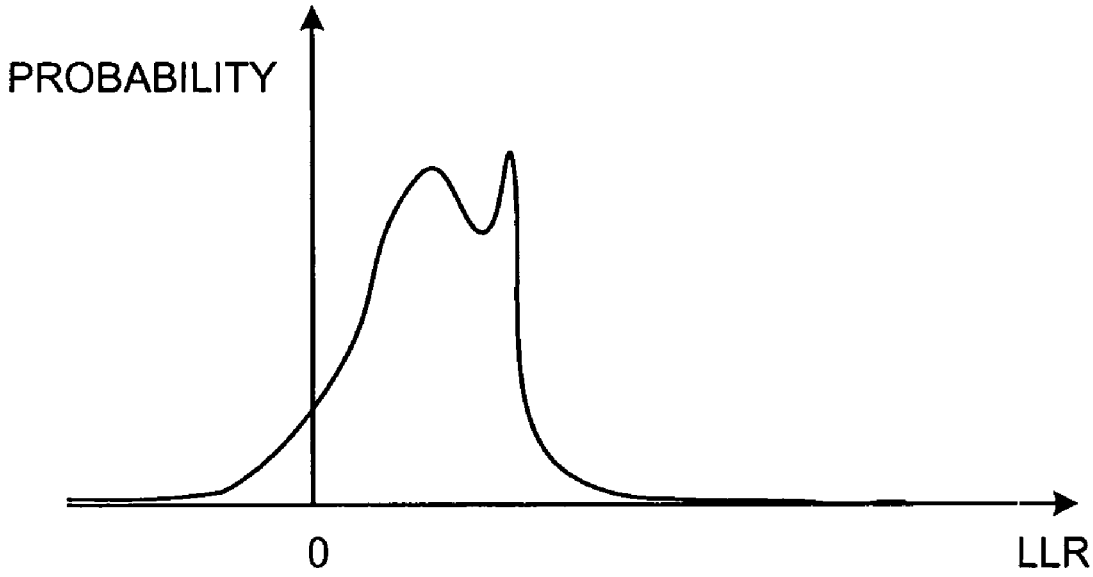
FIG. 14 is an explanatory diagram of a calculation process of a probability density function of an LLR according to a third embodiment.

FIG. 12 to FIG. 17 are explanatory diagrams of a calculation process of a probability density function of the LLR according to the third embodiment. As shown in FIG. 12 (where a black circle denotes a reception point), when the LDPC decoder 5 calculates the LLR by considering the whole modulation points, for example, the LDPC decoder 5 also generates the probability density function of the LLR by considering the whole modulation points, in a method of generating an LDPC code according to the present embodiment. In the example of the "16 QAM Gray Mapping" shown in FIG. 2, the probability density function of the LLR is generated in a similar manner to that according to the first embodiment. FIG. 13 depicts a probability density function of the LLR of the first and the third bits, when the LLR is calculated using the whole modulation points. FIG. 14 depicts a probability density function of the LLR of the second and the fourth bits, when the LLR is calculated using the whole modulation points.

Figure 15:
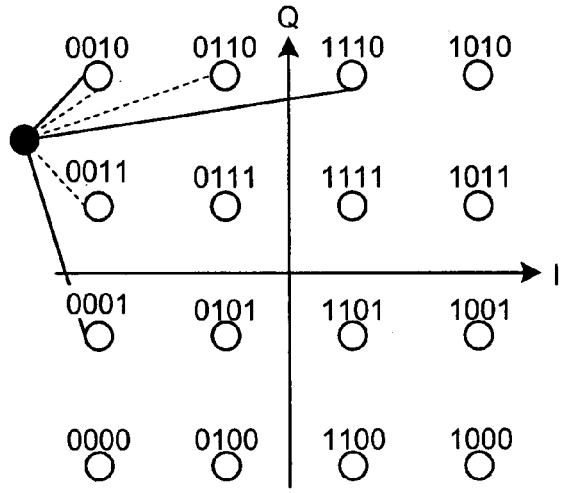
FIG. 15 is an explanatory diagram of a calculation process of a probability density function of an LLR according to a third embodiment.

On the other hand, as shown in FIG. 15, when the LDPC decoder 5 calculates the LLR by using modulation points near the reception point, the LDPC also generates the probability density function of the LLR by considering the modulation points near "0" and "1" of each bit, in the method of generating an LDPC code according to the present embodiment. In FIG. 15, solid lines express points near the first and the third bits, and dotted lines express points near the second and the fourth bits. For example, in the example of the first and the third bits of the "16 QAM Gray Mapping" shown in FIG. 2, the LLR is obtained from Equation (11), and the probability density function is obtained.

[Numerical Expression 6]

$$LLR = \ln\frac{\mathrm{MAX}(p(y \mid x=-3),\ P(y \mid x=-1))}{\mathrm{MAX}(p(y \mid x=+1),\ P(y \mid x=+3))} \tag{11}$$

Figure 16:
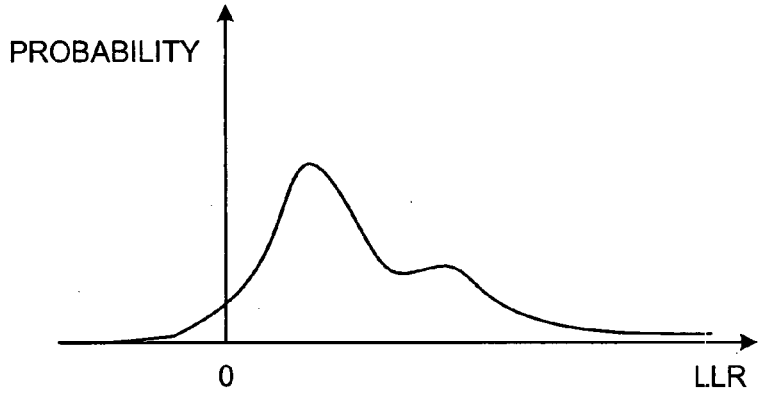
FIG. 16 is an explanatory diagram of a calculation process of a probability density function of an LLR according to a third embodiment.
Figure 17:
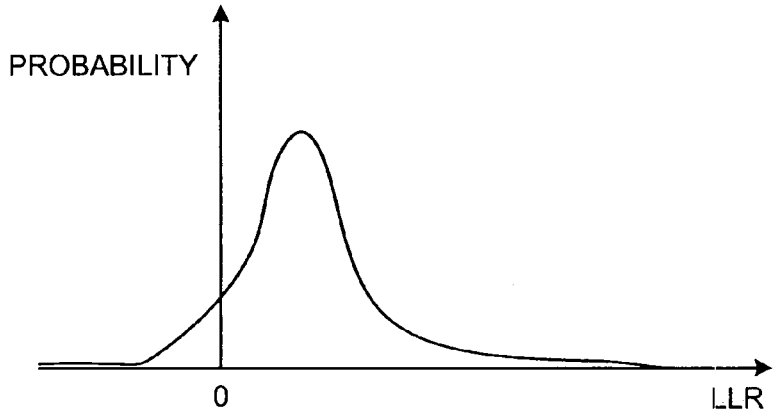
FIG. 17 is an explanatory diagram of a calculation process of a probability density function of an LLR according to a third embodiment.

For the second and the fourth bits, the probability density function of the LLR is obtained by the process similar to that of the first embodiment, as compared with the LLR obtained from Equation (11). FIG. 16 depicts a probability density function of the LLR of the first and the third bits, when the LLR is calculated using the near modulation points. FIG. 17 depicts a probability density function of the LLR of the second and the fourth bits, when the LLR is calculated using the near modulation points.

As explained above, according to the present embodiment, the probability density function of the LLR can be generated, by matching the LLR calculation process performed by the LDPC decoder 5, in addition to the effect of the first or the second embodiment.

Fourth Embodiment

According to a fourth embodiment, when a modulation system is changed in an adaptation modulation system, a generated LDPC code is used in the modulation system before the change, by the method of generating and LDPC code according to the first embodiment. For bit positions that are greatly different between the LLR probability density distribution at each bit position of the modulation system before the change and the LLR probability density distribution at each bit position of the modulation system after the change, columns of the parity check matrix H are replaced, thereby generating a new code.

Figure 18:
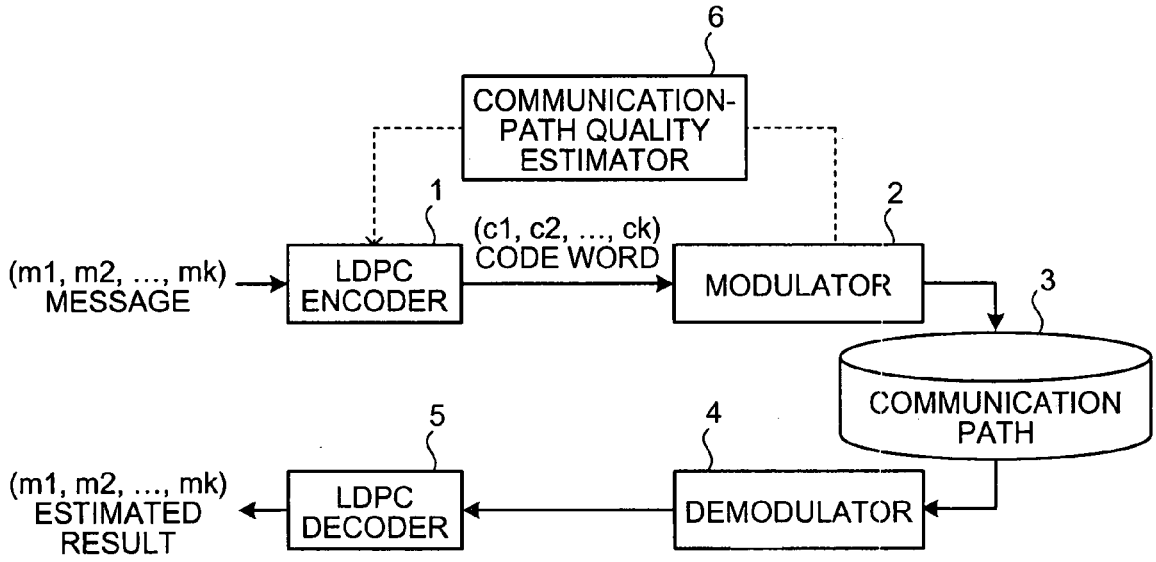
FIG. 18 depicts a configuration of a communication system including an LDPC encoder/decoder according to a fourth embodiment.

FIG. 18 depicts a configuration of a communication system including an LDPC encoder/decoder according to the fourth embodiment. The communication system includes a communication-path quality estimator 6, in addition to the configuration shown in FIG. 1. In the present embodiment, when the communication-path quality estimator 6 detects degradation or improvement of a communication path quality, the communication-path quality estimator 6 instructs the modulator 2 to change the modulation system. The modulator 2 adaptively changes the modulation system, following this instruction. At the same time, the communication-path quality estimator 6 also notifies the LDPC encoder 1 about the change of the modulation system.

Figure 19:
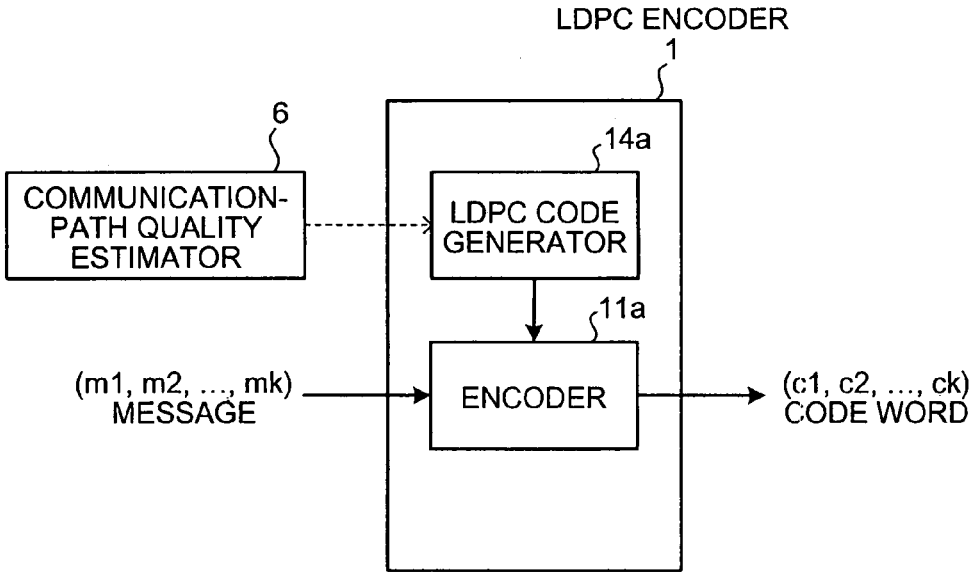
FIG. 19 is one example a configuration of an LDPC encoder.

As shown in FIG. 19, in the LDPC encoder 1, an LDPC code generator 14*a* generates a new LDPC code, based on the notification about the modulation system from the communication-path quality estimator 6. In this case, the parity check matrix H and the generation matrix G that are generated are input to the encoder 11*a*. The parity check matrix H is transmitted to the reception side through the encoder 11*a*.

FIG. 20 is a specific example of the method of generating an LDPC code according to the present embodiment. In the example shown in FIG. 20, first, an LDPC code is generated for the 64 QAM ("Gray Mapping"), by the process similar to that of the first embodiment. The modulation system is then changed to the 16 QAM ("Gray Mapping"), for example, based on the notification about the change of the modulation system from the communication-path quality estimator 6. In this case, a third bit, for example, of the 64 QAM (error rates of the fourth, fifth, and the sixth bits are equivalent to those of the first, the second, and the third bits, respectively) becomes a bit position having a highest error probability among the six bits. Therefore, when the bit position is compared with the corresponding bit position of the 16 QAM after the change, error probabilities are greatly different between the modulation system before the change and the modulation system after the change. Accordingly, when the LDPC code generated for the 64 QAM is used as it is, performance is substantially degraded. Therefore, in the present embodiment, as shown in FIG. 20, columns of the parity check matrix H are replaced with peripheral columns, at the bit position at which the error probability is substantially different (the third bit of the 64 QAM), thereby generating a new LDPC code so as to avoid substantial degradation of the performance.

As described above, in the present embodiment, when the modulation system is changed during communications, columns of the parity check matrix H corresponding to bit positions at which error probabilities are substantially different between the modulation system before the change and the modulation system after the change are replaced with peripheral columns. With this arrangement, even when the communication system employs the adaptation modulation system, the method of generating an LDPC code similar to that of the first embodiment does not need to be individually executed for each modulation system. Further, a new LDPC code can be generated without substantially degrading the performance of each modulation system.

Fifth Embodiment

A method of generating an LDPC code according to a fifth embodiment is explained next. In the fifth embodiment, the process is similar to that of the second embodiment, except that, at step S22 of FIG. 8, a proportion is given to each bit position of a modulation symbol, by excluding the order of the variable node corresponding to the parity bit.

Figure 22:
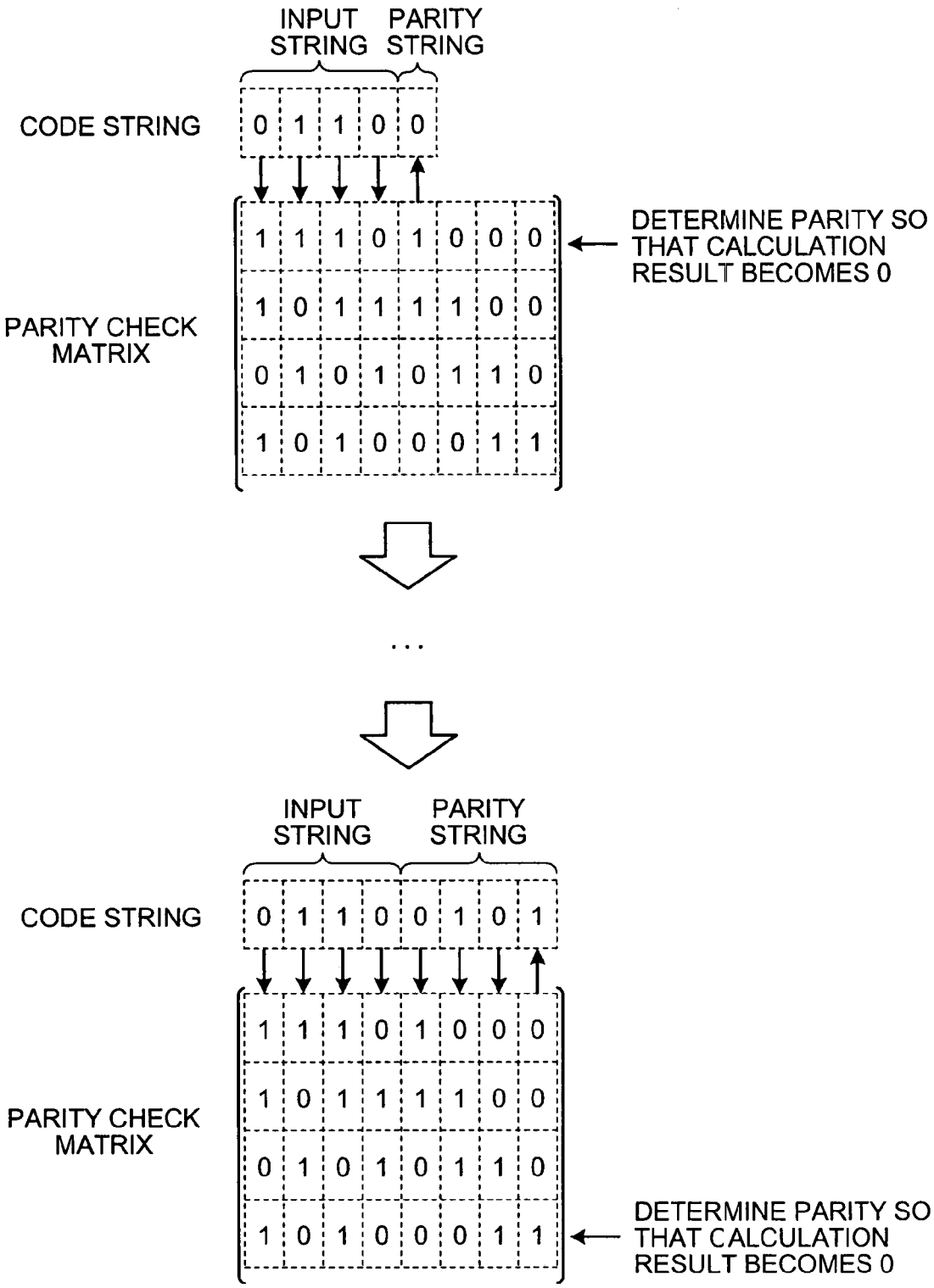
FIG. 22 is one example of a state of executing encoding using a parity check matrix in an LDGM structure.

The process according to the present embodiment is additionally explained with reference to FIG. 21, FIG. 22, and FIG. 23. An order ensemble of the existing parity check matrix H having an LDGM (Low-Density Generation Matrix) structure is prepared. A proportion is allocated to each bit position of a modulation symbol, by excluding the order of the variable node corresponding to the parity bit (the order corresponding to the parity bit has equally probability). After this arrangement, the order ensemble that is suitable for the modulation system is searched. The parity check matrix of the LDGM structure means a parity check matrix capable of sequentially obtaining a parity bit, by providing a dual-diagonal structure in the part corresponding to the parity bit. FIG. 22 is one example of the state of executing encoding using the parity check matrix of the LDGM structure. In this case, parity is determined in a row unit so that a result of the calculation becomes "0". As a result, a code string corresponding to the input string "0110" becomes "01100101".

Figure 23:
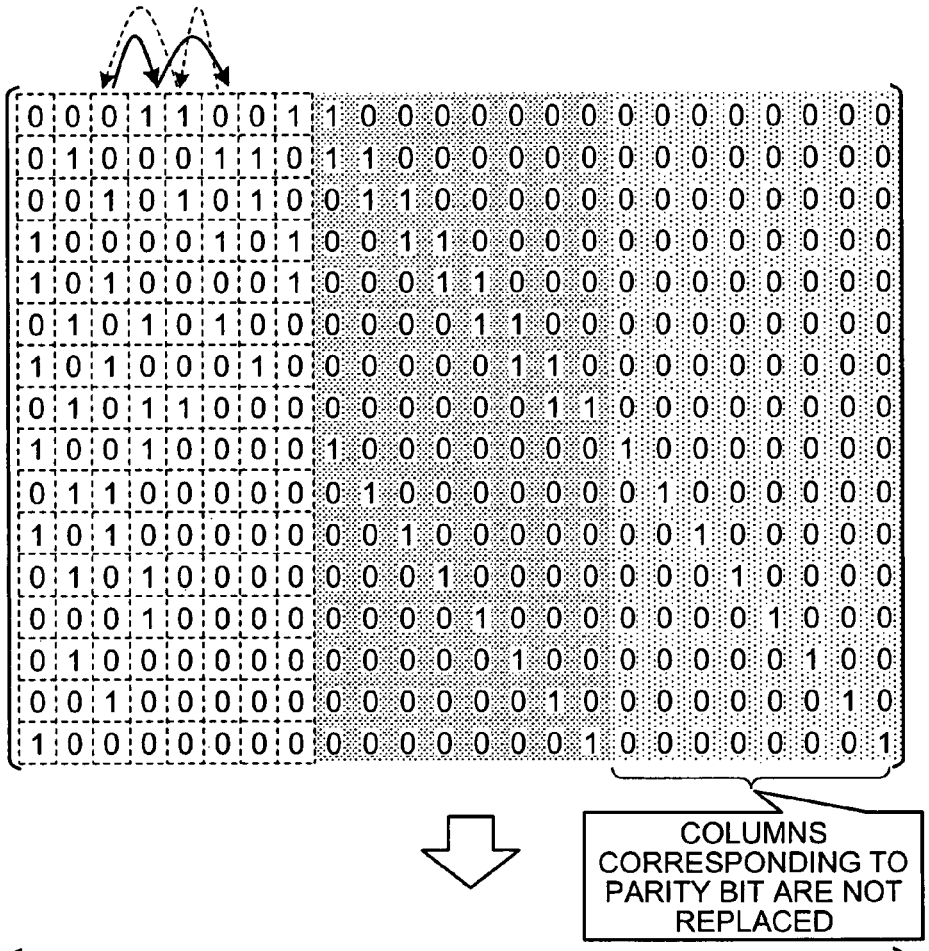
FIG. 23 depicts a generating process of a parity check matrix according to the fifth embodiment.

As shown in FIG. 23, columns of the existing parity check matrix H are replaced, following the obtained order ensemble, thereby obtaining a parity check matrix suitable for the modulation system. Columns corresponding to the parity bits are not replaced.

As described above, according to the present embodiment, a parity check matrix suitable for the modulation system can be obtained while maintaining the LDGM structure of the parity check matrix.

Sixth Embodiment

A method of generating an LDPC code according to a sixth embodiment is explained next. Positioning within a communication system of an LDPC encoder capable of achieving the method of generating an LDPC code according to the present embodiment is similar to that of the first embodiment.

Encoding and a flow of a code according to the present embodiment are explained next. The LDPC encoder 1 at the transmission side generates the code word C, based on the existing parity check matrix H described later having an LDGM structure. Further, based on the method described later, the encoder 1 replaces the order of the code word C, and generates a code word C' to be transmitted to the communication path 3.

Modulation process at the transmission side, and demodulation process and decode process at the reception side are similar to those of the first embodiment. However, the LDPC decoder 5 at the reception side executes the decode process using a parity check matrix H' generated by the method of generating an LDPC code according to the present embodiment described later.

In the present embodiment, the method of searching an order ensemble of the parity check matrix H' to be generated for decoding is similar to that of the second embodiment. The parity check matrix H' is generated by replacing the columns of the parity check matrix H generated by using the existing order ensemble.

Figure 24:
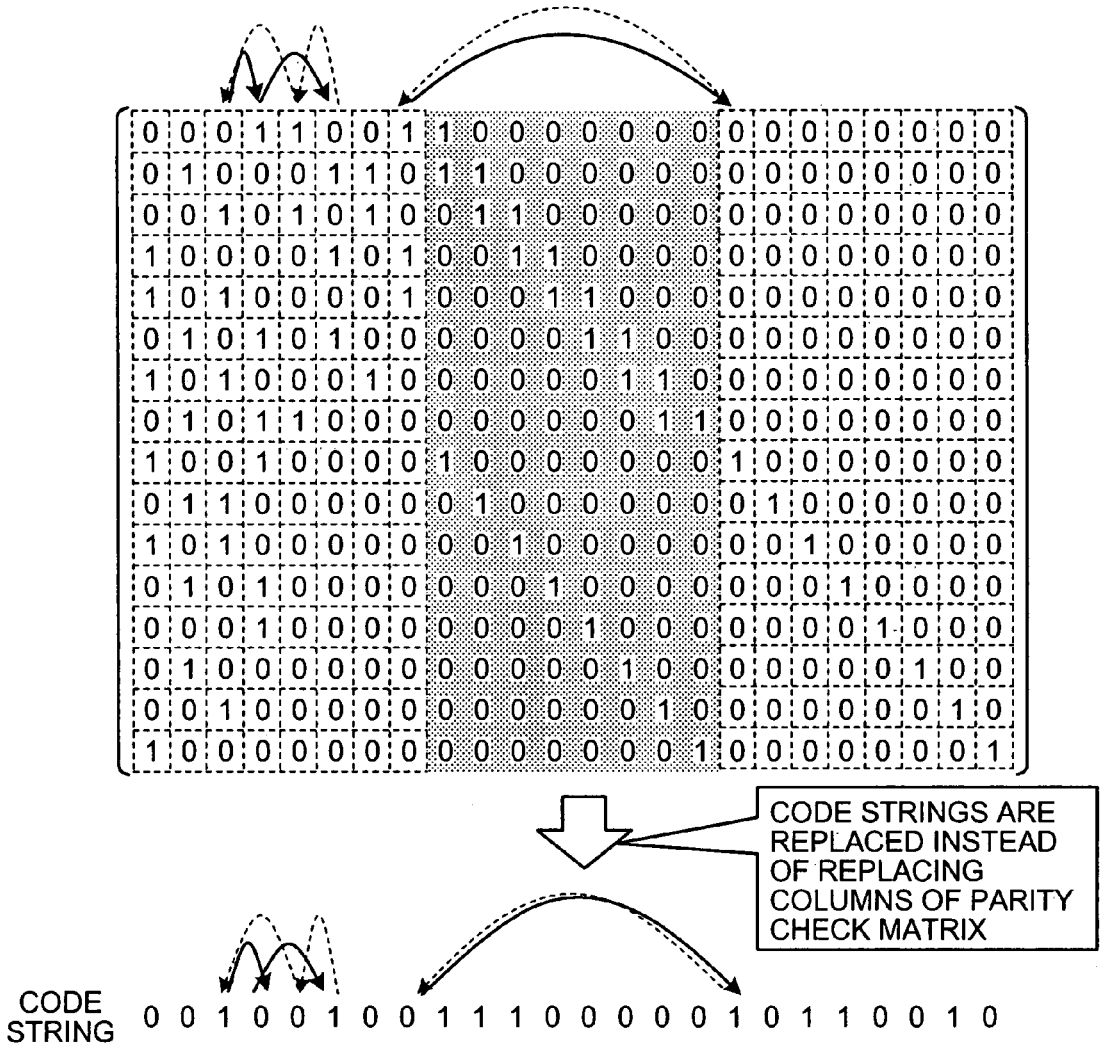
FIG. 24 depicts a conversion process from a code word C into a code word C' in a sixth embodiment.

FIG. 24 depicts a specific image of the conversion from the code word C into the code word C'. According to the present embodiment, a method of rearranging the columns of the parity check matrix H is stored, and this rearrangement method is related to a transmission bit code corresponding to the columns of the parity check matrix H, thereby converting the code word C into the code word C'. In other words, according to the present embodiment, at the encoding side, code words are replaced instead of replacing the columns of the parity check matrix.

As described above, according to the present embodiment, at the encoding side, the process of replacing the order of code words based on the method of replacing the columns of the parity check matrix is added. With this arrangement, while the LDGM structure of the parity check matrix to be used for encoding is maintained, only the process of replacing the order of code words is added at the encoding side, thereby obtaining code words suitable for the modulation system. At the decoding side, a new parity check matrix suitable for the modulation system is generated, thereby decoding in the normal process, without requiring an additional process.

Seventh Embodiment

A method of generating an LDPC code according to a seventh embodiment is explained next. Positioning within a communication system of an LDPC encoder capable of achieving the method of generating an LDPC code according to the present embodiment is similar to that of the first embodiment.

Encoding and a flow of a code according to the present embodiment are explained next. The LDPC encoder 1 at the transmission side generates the code word C, based on a parity check matrix H" described later. Further, based on the method described later, the encoder 1 replaces the order of the code word C, and generates the code word C' to be transmitted to the communication path 3. Modulation process at the transmission side, and demodulation process and decode process at the reception side are similar to those of the first embodiment. However, the LDPC decoder 5 at the reception side executes the decode process using a parity check matrix H", by returning the order of code words replaced at the transmission side to the original order.

First, the order of generating the parity check matrix H", and the order of generating the code word C' are shown below. For example, an order ensemble is searched, in a process similar to that of the second embodiment, and the columns of the existing parity check matrix X are replaced, thereby generating the parity check matrix H". Columns corresponding to the parity bits in the original parity check matrix H are returned to the original positions, in the parity check matrix H'. In vacant columns, columns corresponding to system bits (an input information code to be input to the encoder) in the original parity check code H are moved up, thereby generating the parity check matrix H". In the order ensemble of the existing parity check matrix H, the order of the variable node corresponding to the parity bits needs to be the same.

Figure 25:
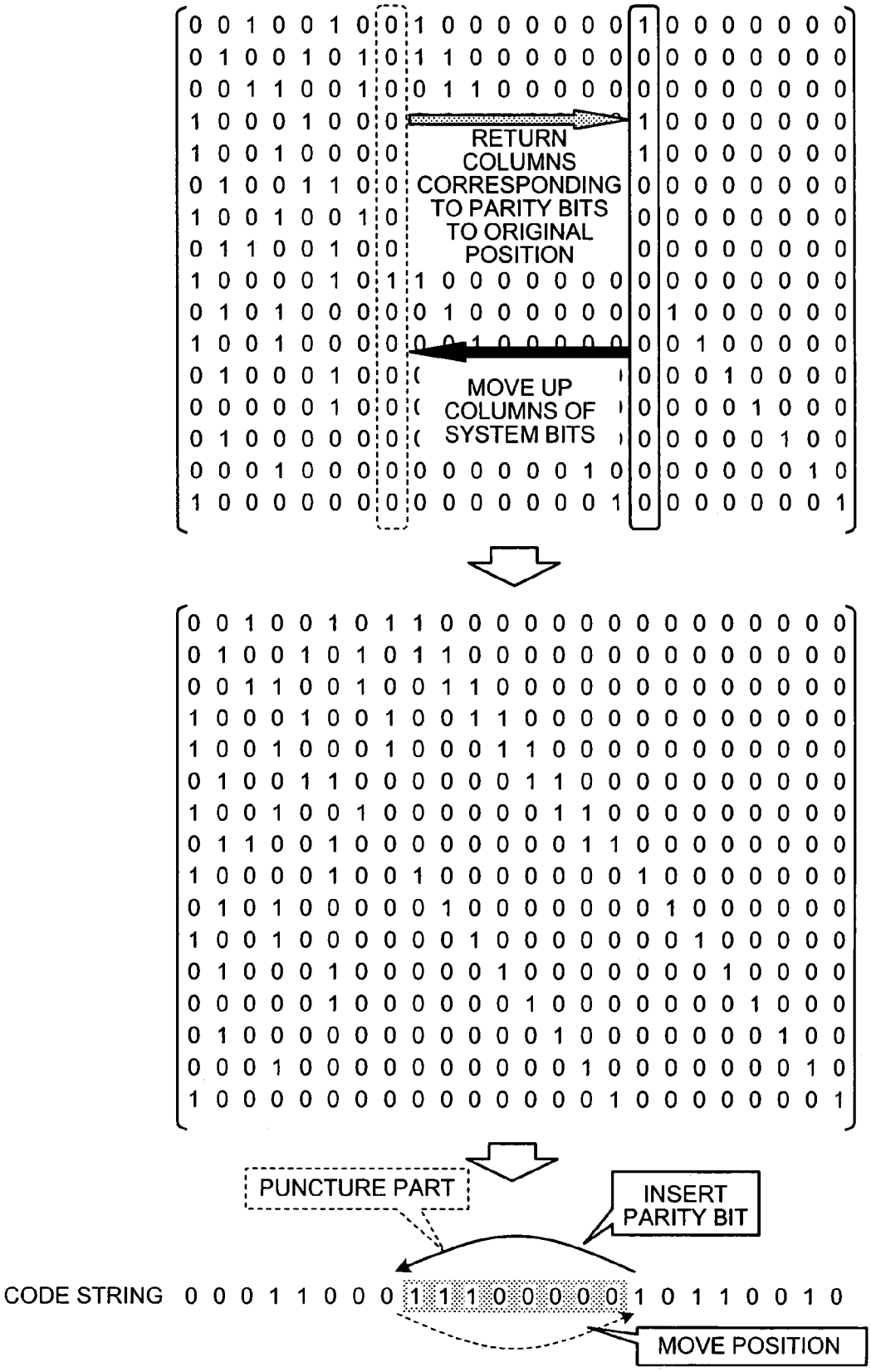
FIG. 25 depicts a conversion process from a code word C into a code word C' in a seventh embodiment.

Conversion of the code word into the code word C' is explained next. FIG. 25 depicts a specific image of the conversion from the code word C into the code word C'. According to the present embodiment, in generating the parity check matrix H" in the parity check matrix H', positions of the columns of the replaced parity bits are stored. Transmission bits corresponding to the original positions returned in the above process are inserted into the positions of the stored columns, in the code word C generated in the parity check matrix H", thereby generating the code word C' corresponding to the parity check matrix H'.

As described above, according to the present embodiment, the process at the encoding side of inserting the transmission bits corresponding to the parity bits into a predetermined position, and the process at the decoding side of returning the reception bits corresponding to the parity bits to the original position are added, respectively. With this arrangement, code words suitable for the modulation system can be obtained, while maintaining the LDGM structure of the parity check matrix.

INDUSTRIAL APPLICABILITY

As described above, the method of generating an LDPC code according to the present invention is useful for a communication apparatus and a communication system that employ an LDPC code for an error correction system. Particularly, the method of generating an LDPC: code according to the present invention is suitable for an encoder that generates an order ensemble that optimizes a parity check matrix in the LDPC code.

The invention claimed is:

1. A method of generating a low-density-parity-check code appllicable to a multi-value modulation system, the method comprising:

order ensemble searching including classifying a distribution of reception signals at each bit position of a modulation symbol; and searching an order ensemble, which is an ensemble of weight of a row and weight of a column, of a parity check matrix that minimizes a signal-to-noise ratio threshold value that is a value of a signal-to-noise ratio at which the bit error rate drops sharply when a code length is sufficiently large; and generating a parity check matrix and a generation matrix, based on the order ensemble obtained as a search result.

2. The method according to claim 1, wherein the order ensemble searching includes a first step including classifying a probability density function of a log likelihood ratio at each bit position of a modulation symbol, as a process of classifying the distribution of the reception signals;

applying a predetermined optimization method to the order ensemble at the time in a search process; and searching a new order ensemble;

a second step including executing repetitively a process of updating a search upper limit and a search lower limit of the signal-to-noise ratio, based on a result of the execution of "density evolution" in the new order ensemble until a predetermined standard is satisfied; and obtaining the signal-to-noise ratio threshold value, based on the search upper limit and the search lower limit of the signal-to-noise ratio at the time of satisfying the standard; and a third step of determining whether obtained signal-to-noise ratio threshold value is a desired signal-to-noise ratio threshold value, and the above processes are repetitively executed until the desired signal-to-noise ratio threshold value is obtained.

3. The method according to claim 1, wherein a distribution of reception signals at each bit position of a modulation symbol is calculated, in line with a likelihood calculation process of a decoder.

4. The method according to claim 1, wherein when a modulation system is changed during communications, columns of a parity check matrix corresponding to bit positions at which error probabilities are substantially different between the modulation system before the change and the modulation system after the change are replaced with peripheral columns.

5. A method of generating a low-density-parity-check code applicable to a multi-value modulation system, the method comprising:

a first order ensemble search step of searching the order ensemble, which is an ensemble of weight of a row and weight of a column, minimizing a signal-to-noise ratio threshold value that is a value of a signal-to-noise ratio at which a bit error rate drops sharply when a code length is sufficiently large, by a known method;

a second order ensemble search step including giving a proportion of each modulation symbol bit position to each order by a predetermined number of times while changing the value of the proportion;

classifying a distribution of reception signals at each bit position of a modulation symbol, to the order ensemble obtained as a search result; and searching the order ensemble of a parity check matrix that minimizes the signal-to-noise ratio threshold value, by using each proportion as a parameter; and a code generation step of generating a parity check matrix and a generation matrix, based on the order ensemble obtained at the second order ensemble search step.

6. The method according to claim 5, wherein a distribution of reception signals at each bit position of a modulation symbol is calculated, in line with a likelihood calculation process of a decoder.

7. The method according to claim 5, wherein when a modulation system is changed during communications, columns of a parity check matrix corresponding to bit positions at which error probabilities are substantially different between the modulation system before the change and the modulation system after the change are replaced with peripheral columns.

8. A method of generating a low-density-parity-check code applicable to a multi-value modulation system, the method comprising:

an order ensemble search step including giving a proportion of each modulation symbol bit position to each order by a predetermined number of times while changing the value of the proportion;

classifying a distribution of reception signals at each bit position of a modulation symbol, to a known order ensemble to be fixedly used, which is an ensemble of weight of a row and weight of a column; and searching the order ensemble of a parity check matrix that minimizes a signal-to-noise ratio threshold value that is a value of a signal-to-noise ratio at which the bit error rate drops sharply when a code length is sufficiently large, by using each proportion as a parameter; and a code generation step of generating a parity check matrix and a generation matrix, based on the order ensemble obtained at the order ensemble search step.

9. The method according to claim 8, wherein a distribution of reception signals at each bit position of a modulation symbol is calculated, in line with a likelihood calculation process of a decoder.

10. The method according to claim 8, wherein when a modulation system is changed during communications, columns of a parity check matrix corresponding to bit positions at which error probabilities are substantially different between the modulation system before the change and the modulation system after the change are replaced with peripheral columns.

11. A communication apparatus that employs a low-density-parity-check code as a coding system for a multi-value modulation system, the communication apparatus comprising:

an order ensemble searching unit that classifies a distribution of reception signals at each bit position of a modulation symbol, and searches an order ensemble, which is an ensemble of weight of a row and weight of a column, of a parity check matrix that minimizes a signal-to-noise ratio threshold value that is a value of a signal-to-noise ratio at which the bit error rate drops sharply when a code length is sufficiently large; and a code generating unit that generates a parity check matrix and a generation matrix, based on the order ensemble obtained as a search result.

12. A communication apparatus that employs a low-density-parity-check code as a coding system for a multi-value modulation system, the communication apparatus comprising:

a first order ensemble searching unit that searches an order ensemble, which is an ensemble of weight of a row and weight of a column, minimizing a signal-to-noise ratio threshold value that is a value of a signal-to-noise ratio at which a bit error rate drops sharply when a code length is sufficiently large, by a known method;

a second order ensemble searching unit that gives a proportion of each modulation symbol bit position to each order by a predetermined number of times while changing the value of the proportion, classifies a distribution of reception signals at each bit position of a modulation symbol, to the order ensemble obtained as a search result, and searches the order ensemble of a parity check matrix that minimizes the signal-to-noise ratio threshold value; by using each proportion as a parameter; and a code generating unit that generates a parity check matrix and a generation matrix, based on the order ensemble obtained by the second order ensemble searching unit.

13. A communication apparatus that employs a low-density-parity-check code as a coding system for a multi-value modulation system, the communication apparatus comprising:

an order ensemble searching unit that gives a proportion of each modulation symbol bit position to each order by a predetermined number of times while changing the value of the proportion, classifies a distribution of reception signals at each bit position of a modulation symbol, to a known order ensemble to be fixedly used, which is an ensemble of weight of a row and weight of a column, and searches an order ensemble of a parity check matrix that minimizes a signal-to-noise ratio threshold value that is a value of a signal-to-noise ratio at which the bit error rate drops sharply when a code length is sufficiently large, by using each proportion as a parameter; and a code generating unit that generates a parity check matrix and a generation matrix, based on the order ensemble obtained by the order ensemble searching unit.

14. A method of generating a low-density-parity-check code applicable to a multi-value modulation system, the method comprising:

an order ensemble search step including preparing a known order ensemble, which is an ensemble of weight of a row and weight of a column of a parity check matrix row, to be fixedly used;

giving a proportion of each modulation symbol bit position to each order by a prescribed number of times while changing the value of the proportion, by excluding the order of a variable node corresponding to a parity bit;

classifying a distribution of reception signals at each bit position of a modulation symbol; and searching an order ensemble that minimizes a signal-to-noise ratio threshold value that is a value of a signal-to-noise ratio at which the bit error rate drops sharply when a code length is sufficiently large, by using each proportion as a parameter; and a code generation step of generating a parity check matrix of a low-density-generation-matrix structure, based on the order ensemble obtained at the order ensemble search step.

15. A method of generating a low-density-parity-check code applicable to a multi-value modulation system, the method comprising:

an order ensemble search step including preparing a known order ensemble, which is an ensemble of weight of a row and weight of a column of a parity check matrix row, to be fixedly used;

giving a proportion of each modulation symbol bit position to each order by a prescribed number of times while changing the value of the proportion;

classifying a distribution of reception signals for each modulation symbol bit position; and searching an order ensemble that minimizes a signal-to-noise ratio threshold value that is a value of a signal-to-noise ratio at which the bit error rate drops sharply when a code length is sufficiently large, by using each proportion as a parameter; and a code generation step of generating a new parity check matrix, by replacing columns of a parity check matrix of a low-density-generation-matrix structure obtained from the known order ensemble, based on the order ensemble obtained at the order ensemble search step.

16. A method of generating a low-density-parity-check code applicable to a multi-value modulation system, the method comprising:

an order ensemble search step including preparing a known order ensemble, which is an ensemble of weight of a row and weight of a column of a parity check matrix row, to be fixedly used;

giving a proportion of each modulation symbol bit position to each order by a prescribed number of times while changing the value of the proportion;

classifying a distribution of reception signals for each modulation symbol bit position; and searching an order ensemble that minimizes a signal-to-noise ratio threshold value that is a value of a signal-to-noise ratio at which the bit error rate drops sharply when a code length is sufficiently large, by using each proportion as a parameter; and a code generation step including generating a second parity check matrix by replacing columns of a first parity check matrix of a low-density-generation-matrix structure obtained from the known order ensemble, based on the order ensemble obtained at the order ensemble search step; and generating a third parity check matrix for encoding by returning columns of parity bits in the first parity check code to the original positions, in the second parity check matrix, and moving up the columns that become vacant due to the returning of the columns.

17. A method of generating a code string using a parity check matrix generated by a process of generating a low-density-parity-check code applicable to a multi-value modulation system, the method comprising:

an order ensemble search step including preparing a known order ensemble, which is an ensemble of weight of a row and weight of a column of a parity check matrix row, to be fixedly used;

giving a proportion of each modulation symbol bit position to each order by a prescribed number of times while changing the value of the proportion;

classifying a distribution of reception signals for each modulation symbol bit position; and searching an order ensemble of a parity check matrix that minimizes a signal-to-noise ratio threshold value that is a value of a signal-to-noise ratio at which the bit error rate drops sharply when a code length is sufficiently large, by using each proportion as a parameter;

a code generation step of generating a new parity check matrix, by replacing columns of a parity check matrix of a low-density-generation-matrix structure obtained from the known order ensemble, based on the order ensemble obtained at the order ensemble search step; and a code replacement step of obtaining a final code string by storing a replacement pattern of columns of a generated parity check matrix, encoding based on a parity check matrix of the low-density-generation-matrix structure obtained from the known order ensemble, and replacing an obtained code string, following the stored replacement pattern of the columns.

18. A method of generating a code string using a parity check matrix generated by a process of generating a low-density-parity-check code applicable to a multi-value modulation system, the method comprising:

an order ensemble search step including preparing a known order ensemble, which is an ensemble of weight of a row and weight of a column of a parity check matrix row, to be fixedly used;

giving a proportion of each modulation symbol bit position to each order by a prescribed number of times while changing the value of the proportion;

classifying a distribution of reception signals for each modulation symbol bit position; and searching an order ensemble that minimizes a signal-to-noise ratio threshold value that is a value of a signal-to-noise ratio at which the bit error rate drops sharply when a code length is sufficiently large, by using each proportion as a parameter;

a code generation step including generating a second parity check matrix by replacing columns of a first parity check matrix of a low-density-generation-matrix structure obtained from the known order ensemble, based on the order ensemble obtained at the order ensemble search step; and generating a third parity check matrix for encoding by returning columns of parity bits in the first parity check code to the original positions, in the second parity check matrix, and moving up the columns that become vacant due to the returning of the columns; and a code replacement step of obtaining a final code string by storing a position of columns in which the parity bits returned to the original position is present, encoding based on the third parity check matrix, and inserting transmission bits corresponding to the original position into the stored position of the columns, in an obtained code string.

* * * * *